US009039365B2

(12) United States Patent
Farineau et al.

(10) Patent No.: US 9,039,365 B2
(45) Date of Patent: May 26, 2015

(54) ROTOR, A STEAM TURBINE AND A METHOD FOR PRODUCING A ROTOR

(75) Inventors: Thomas Joseph Farineau, Schoharie, NY (US); Robin Carl Schwant, Pattersonville, NY (US)

(73) Assignee: General Electric Company, Schenectady, NY (US)

( * ) Notice: Subject to any disclaimer, the term of this patent is extended or adjusted under 35 U.S.C. 154(b) by 623 days.

(21) Appl. No.: 13/344,677

(22) Filed: Jan. 6, 2012

(65) Prior Publication Data

US 2013/0177407 A1 Jul. 11, 2013

(51) Int. Cl.
*F01D 5/02* (2006.01)
*F01D 5/06* (2006.01)

(52) U.S. Cl.
CPC ..... *F01D 5/06* (2013.01); *Y10T 29/49327* (2015.01); *F01D 5/026* (2013.01); *F01D 5/022* (2013.01); *F01D 5/023* (2013.01); *F01D 5/063* (2013.01)

(58) Field of Classification Search
USPC ..... 415/200, 216.1, 199.4, 199.5, 221, 220; 416/201 R, 198 A, 213 R, 244 R, 244 A, 416/241 R; 420/109; 148/325, 335; 428/683, 685
See application file for complete search history.

(56) References Cited

U.S. PATENT DOCUMENTS 5,779,821 A * 7/1998 Ishii et al. ..... 148/326
6,152,697 A 11/2000 Konishi et al.
6,454,531 B1 9/2002 Crawmer
6,499,946 B1 12/2002 Yamada et al.
6,575,700 B2 * 6/2003 Arai et al. ..... 415/200
6,749,518 B2 6/2004 Carrier et al.
6,755,920 B2 * 6/2004 Yamaguchi et al. ..... 148/335
7,179,342 B2 2/2007 Scarlin
7,771,166 B2 8/2010 Heine et al.
7,850,423 B2 12/2010 Yamashita
7,946,813 B2 * 5/2011 Fukuda et al. ..... 415/216.1
2003/0185700 A1 * 10/2003 Ishii et al. ..... 420/109
2007/0253812 A1 * 11/2007 Yamashita ..... 415/200

(Continued)

FOREIGN PATENT DOCUMENTS

DE 19628506 A1 1/1998
EP 0759499 A1 2/1997

(Continued)

OTHER PUBLICATIONS

Search Report and Written Opinion from EP Application No. 12198589.9 dated Jul. 8, 2013.

*Primary Examiner* — Dwayne J White
*Assistant Examiner* — Justin Seabe
(74) *Attorney, Agent, or Firm* — McNees Wallace & Nurick LLC

(57) ABSTRACT

A rotor, a steam turbine having a rotor, and a method of producing a rotor are disclosed. The rotor disclosed includes a shaft high pressure section. The high pressure section includes a first high pressure section, a second high pressure section, the second high pressure section being joined to the first pressure section, and a third high pressure section, the third high pressure section being joined to the second high pressure section. At least a portion of the second high pressure section is formed of a high-chromium alloy steel comprising 0.1-1.2 wt % of Mn, up to 1.5 wt % of Ni, 8.0-15.0 wt % of Cr, up to 4.0 wt % of Co, 0.5-3.0 wt % of Mo, 0.05-1.0 wt % of V, 0.02-0.5 wt % of Nb, 0.005-0.15 wt % of N, up to 0.04 wt % of B, up to 3.0 wt % of W, and balance Fe and incidental impurities.

18 Claims, 3 Drawing Sheets

(56) References Cited

U.S. PATENT DOCUMENTS

2009/0232646 A1* 9/2009 Schmitz et al. ..... 415/177
2011/0100961 A1 5/2011 Kilroy

FOREIGN PATENT DOCUMENTS

JP 2008093668 A * 4/2008
WO WO 2010133244 A1 * 11/2010

* cited by examiner

ROTOR, A STEAM TURBINE AND A METHOD FOR PRODUCING A ROTOR

FIELD OF THE INVENTION

The present invention is generally directed to steam turbines, and more specifically directed to a supercritical steam turbine having a welded rotor shaft.

BACKGROUND OF THE INVENTION

A typical steam turbine plant may be equipped with a high pressure steam turbine, an intermediate pressure steam turbine and a low pressure steam turbine. Each steam turbine is formed of materials appropriate to withstand operating conditions, pressure, temperature, flow rate, etc., for that particular turbine.

Recently, steam turbine plant designs directed toward a larger capacity and a higher efficiency have been designed that include steam turbines that operate over a range of pressures and temperatures. The designs have included high-low pressure integrated, high-intermediate-low pressure integrated, and intermediate-low pressure integrated steam turbine rotors integrated into one piece and using the same metal material for each steam turbine. Often, a metal is used that is capable of performing in the highest of operating conditions for that turbine, thereby increasing the overall cost of the turbine.

A steam turbine conventionally includes a rotor and a casing jacket. The rotor includes a rotatably mounted turbine shaft that includes blades. When heated and pressurized steam flows through the flow space between the casing jacket and the rotor, the turbine shaft is set in rotation as energy is transferred from the steam to the rotor. The rotor, and in particular the rotor shaft, often forms of the bulk of the metal of the turbine. Thus, the metal that forms the rotor significantly contributes to the cost of the turbine. If the rotor is formed of a high cost, high temperature metal, the cost is even further increased.

Accordingly, it would be desirable to provide a steam turbine rotor formed of less high temperature materials than known in the art for steam turbine rotor construction.

SUMMARY OF THE INVENTION

According to an exemplary embodiment of the present disclosure, a rotor is disclosed that includes a rotor having a shaft high pressure section having a first end and a second end and a shaft intermediate pressure section joined to the second end of the shaft high pressure section. The high pressure section includes a first high pressure section, a second high pressure section, the second high pressure section being joined to the first pressure section, and a third high pressure section, the third high pressure section being joined to the second high pressure section. The shaft intermediate pressure section includes a first intermediate pressure section and a second intermediate pressure section, the second intermediate pressure section being joined to the first intermediate pressure section. At least a portion of the second high pressure section is formed of a high-chromium alloy steel comprising 0.1-1.2 wt % of Mn, up to 1.5 wt % of Ni, 8.0-15.0 wt % of Cr, up to 4.0 wt % of Co, 0.5-3.0 wt % of Mo, 0.05-1.0 wt % of V, 0.02-0.5 wt % of Nb, 0.005-0.15 wt % of N, up to 0.04 wt % of B, up to 3.0 wt % of W, and balance Fe and incidental impurities.

According to another exemplary embodiment of the present disclosure, a super critical steam turbine is disclosed that includes a rotor. The rotor includes a shaft high pressure section having a first end and a second end and a shaft intermediate pressure section joined to the second end of the shaft high pressure section. The high pressure section includes a first high pressure section, a second high pressure section, the second high pressure section being joined to the first pressure section, and a third high pressure section, the third high pressure section being joined to the second high pressure section. The shaft intermediate pressure section includes a first intermediate pressure section and a second intermediate pressure section, the second intermediate pressure section being joined to the first intermediate pressure section. At least a portion of the second high pressure section is formed of a high-chromium alloy steel comprising 0.1-1.2 wt % of Mn, up to 1.5 wt % of Ni, 8.0-15.0 wt % of Cr, up to 4.0 wt % of Co, 0.5-3.0 wt % of Mo, 0.05-1.0 wt % of V, 0.02-0.5 wt % of Nb, 0.005-0.15 wt % of N, up to 0.04 wt % of B, up to 3.0 wt % of W, and balance Fe and incidental impurities.

According to another exemplary embodiment of the present disclosure, a method of manufacturing a rotor is disclosed that includes providing a first, second and third high pressure sections and joining the first, second and third high pressure sections to form a shaft high pressure rotor section. The method further includes providing a first and second intermediate pressure sections and joining the first and second intermediate pressure sections to form a shaft intermediate pressure section. The shaft high pressure section and the shaft intermediate pressure sections are joined to form a rotor. At least a portion of the second high pressure section is formed of a high-chromium alloy steel comprising 0.1-1.2 wt % of Mn, up to 1.5 wt % of Ni, 8.0-15.0 wt % of Cr, up to 4.0 wt % of Co, 0.5-3.0 wt % of Mo, 0.05-1.0 wt % of V, 0.02-0.5 wt % of Nb, 0.005-0.15 wt % of N, up to 0.04 wt % of B, up to 3.0 wt % of W, and balance Fe and incidental impurities.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

The present disclosure now will be described more fully hereinafter with reference to the accompanying drawings, in which an exemplary embodiment of the disclosure is shown. This disclosure may, however, be embodied in many different forms and should not be construed as limited to the embodiments set forth herein.

In embodiments of the present disclosure, the system configuration provides a lower cost steam turbine rotor. Another advantage of an embodiment of the present disclosure includes reduced manufacturing time as the lead time for procuring a multi-component rotor is less than that of a rotor forged from a single-piece forging. Embodiments of the present disclosure allow the fabrication of the high pressure/intermediate pressure rotor from a series of smaller forgings made from the same material that are either a) less expensive on a per pound basis than a single forging or b) offer a time savings in terms of procurement cycle vs. a single larger one-piece forging. Such arrangements provide less expensive manufacturing. In addition, the arrangement of the present disclosure is suitable for multi-casing intermediate (IP) turbine sections.

Figure 1:
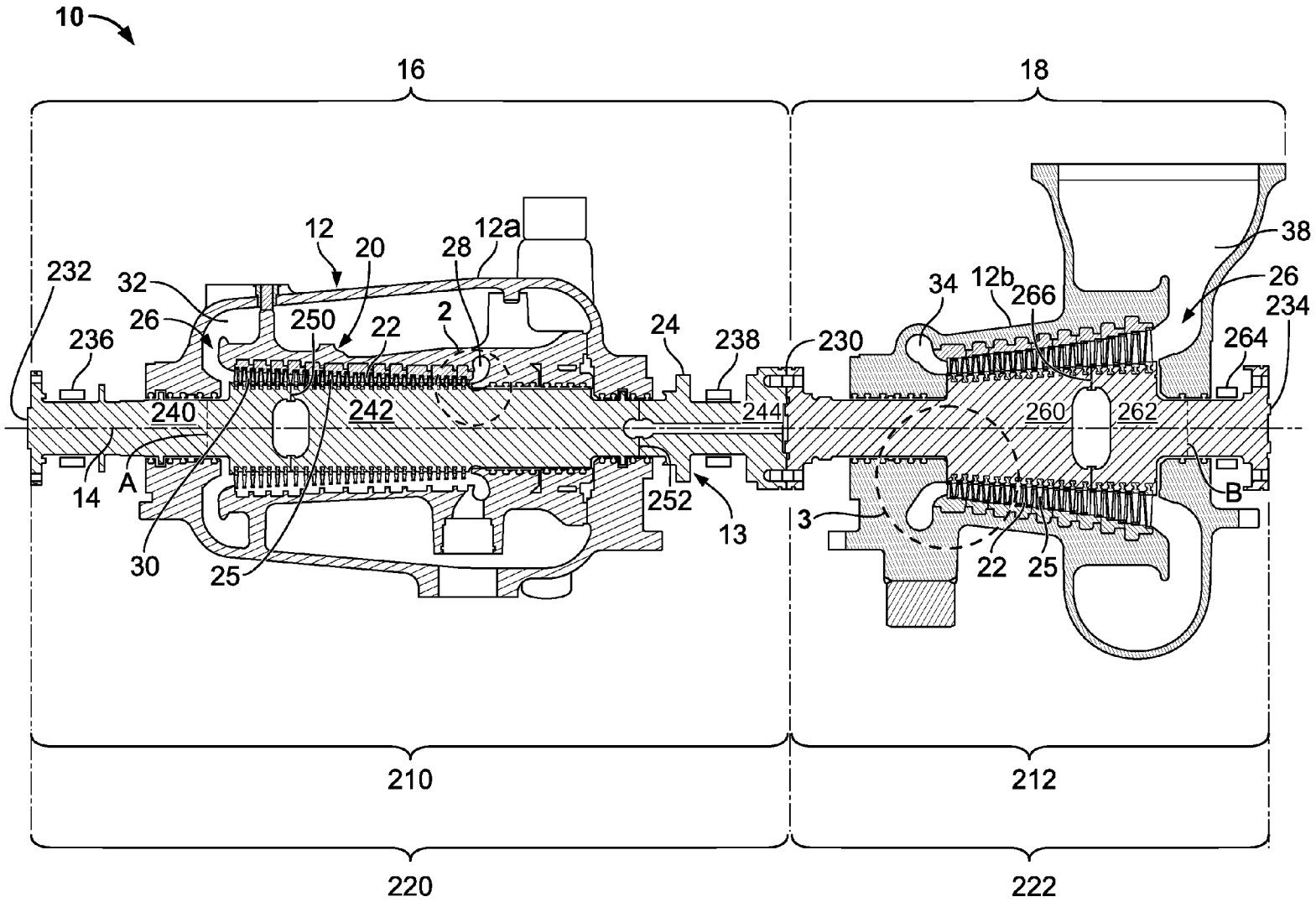
FIG. 1 is a sectional view of a steam turbine according to the present disclosure.
Figure 2:
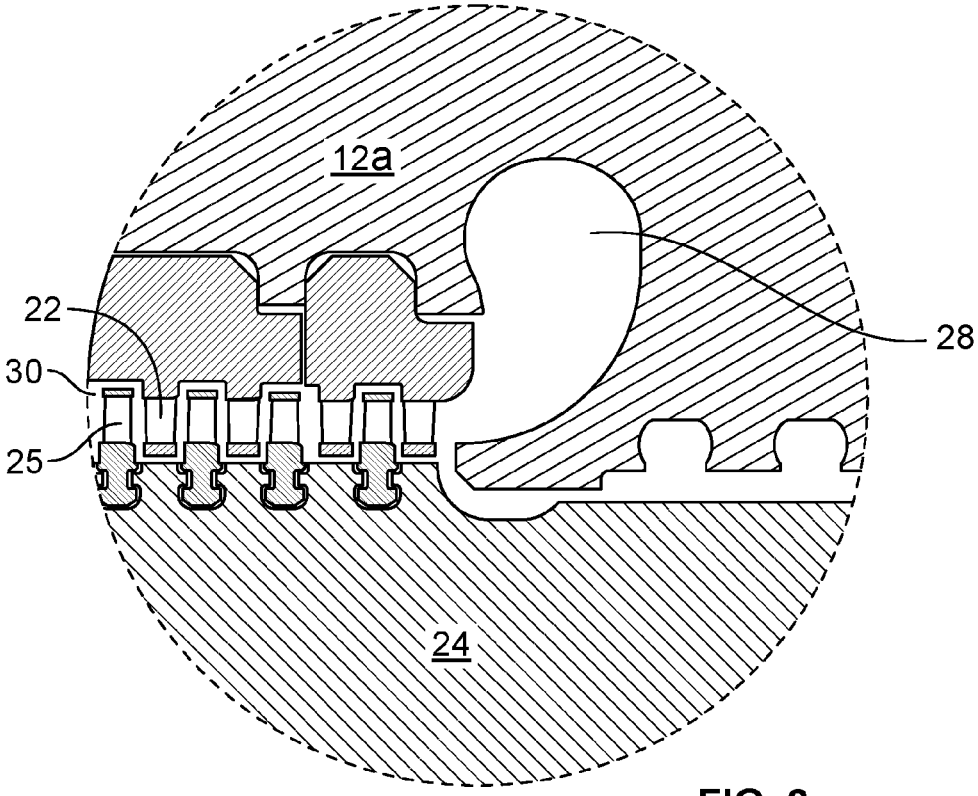
FIG. 2 is a sectional view of a portion of FIG. 1.
Figure 3:
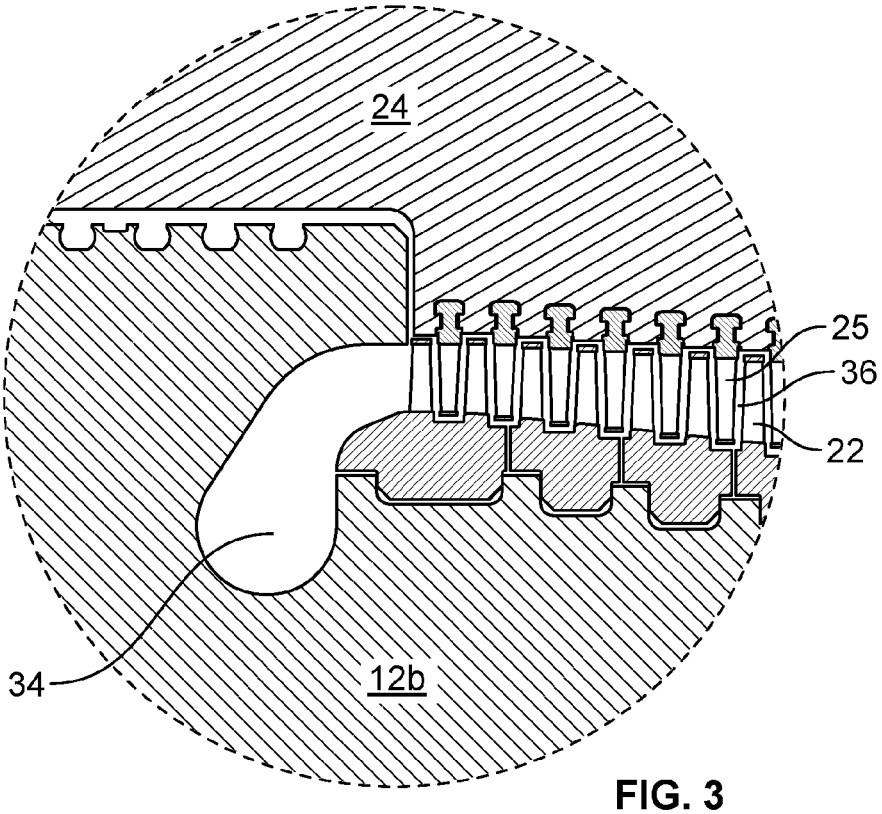
FIG. 3 is a sectional view of another portion of FIG. 1.

FIGS. 1, 2 and 3 illustrate a sectional diagram of a steam turbine 10 according to an embodiment of the disclosure. FIGS. 2 and 3 illustrate expanded views as indicated on the sectional diagram of FIG. 1. The steam turbine 10 includes a casing 12 in which a turbine rotor 13 is mounted rotatably about an axis of rotation 14. The steam turbine 10 includes a high pressure (HP) section 16 and an intermediate pressure (IP) section 18.

The steam turbine 10 operates at super-critical operating conditions. In one embodiment, the high pressure section 16 of steam turbine 10 receives steam at a pressure above about 220 bar. In another embodiment, the high pressure section 16 receives steam at a pressure between about 220 bar and about 340 bar. In another embodiment, the high pressure section 16 receives steam at a pressure between about 220 bar to about 240 bar. Additionally, the high pressure section 16 receives steam at a temperature between about 590° C. and about 650° C. In another embodiment, the high pressure section 16 receives steam at a temperature between about 590° C. and about 625° C.

The casing 12 includes an HP casing 12*a* and an IP casing 12*b*. The HP casing 12*a* and IP casing 12*b* are separate components, or, in other words, are not integral. In the exemplary embodiment shown in FIG. 1, the HP casing 12*a* is a double wall casing and IP casing 12*b* is a single wall casing. In another embodiment, the IP casing 12*b* may be a double wall casing 12*b* as shown in another exemplary embodiment illustrated in FIG. 4. The embodiment shown in FIG. 4 includes all of the components shown and described with respect to FIG. 1, with a double wall casing 12*b* in the IP section 18. The casing 12 includes a inner casing 20 and a plurality of guide vanes 22 attached to the inner casing 20. The rotor 13 includes a shaft 24 and a plurality of blades 25 fixed to the shaft 24. The shaft 24 is rotatably supported by a first bearing 236, a second bearing 238, and third bearing 264.

A main steam flow path 26 is defined as the path for steam flow between the casing 12 and the rotor 13. The main steam flow path 26 includes an HP main steam flow path section 30 located in the turbine HP section 16 and an IP main steam flow path section 36 located in the turbine IP section 18. As used herein, the term "main steam flow path" means the primary flow path of steam that produces power.

Steam is provided to an HP inflow region 28 of the main steam flow path 26. The steam flows through the HP main steam flow path section 30 of the main steam flow path 26 between vanes 22 and blades 25, during which the steam expands and cools. Thermal energy of the steam is converted into mechanical, rotational energy as the steam rotates the rotor 13 about the axis 14. After flowing through the HP main steam flow path section 30, the steam flows out of an HP steam outflow region 32 into an intermediate superheater (not shown), where the steam is heated to a higher temperature. The steam is introduced via lines (not shown) to an IP main steam inflow region 34. The steam flows through an IP main steam flow path section 36 of the main steam flow path 26 between vanes 22 and blades 25, during which the steam expands and cools. Additional thermal energy of the steam is converted into mechanical, rotational energy as the steam rotates the rotor 13 about the axis 14. After flowing through the IP main steam flow path section 36, the steam flows out of an IP steam outflow region 38 out of the steam turbine 10. The steam may be used in other operations, not illustrated in any more detail.

Figure 4:
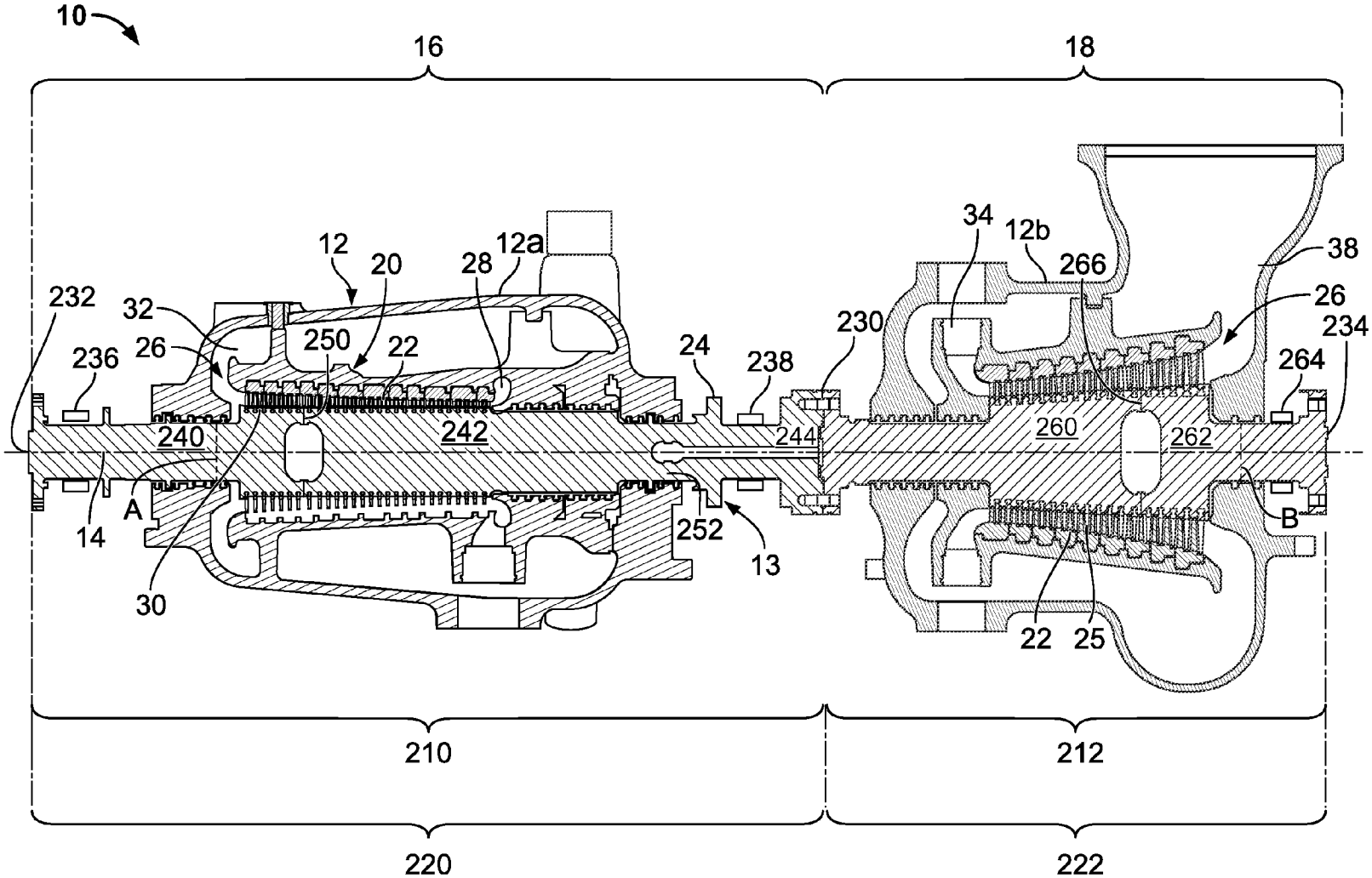
FIG. 4 is a sectional view of another embodiment of a steam turbine according to the present disclosure.

As can further be seen in FIGS. 1 and 4, the rotor 13 includes a rotor HP section 210 located in the turbine HP section 16 and a rotor IP section 212 located in the turbine IP section 18. The rotor 13 includes a shaft 24. Correspondingly, the shaft 24 includes a shaft HP section 220 located in the turbine HP section 16 and a shaft IP section 222 located in the turbine IP section 18. The shaft HP and IP sections 220 and 222 are joined at a bolted joint 230. In another embodiment, the shaft HP and IP sections 220 and 222 are joined by welding, bolting, or other joining technique.

The shaft HP section 220 may be joined to another component (not shown) at the first end 232 of the shaft 24 by a bolted joint, a weld, or other joining technique. In another embodiment, the shaft HP section 220 may be bolted to a generator at the first end 232 of shaft 24. The shaft IP section 222 may be joined to another component (not shown) at a second end 234 of the shaft 24 by a bolted joint, a weld, or other joining technique. In another embodiment, the shaft IP section 222 may be joined to a low pressure section at the second end 234 of shaft 24. In another embodiment, the low pressure section may include a low pressure turbine.

The shaft HP section 220 receives steam via the HP inflow region 28 at a pressure above 220 bar. In another embodiment, the shaft HP section 220 may receive steam at a pressure between about 220 bar and about 340 bar. In another embodiment, the shaft HP section 220 may receive steam at a pressure between about 220 bar to about 240 bar. The shaft HP section 220 receives steam at a temperature of between about 590° C. and about 650° C. In another embodiment, the shaft HP section 220 may receive steam at a temperature between about 590° C. and about 625° C.

The shaft HP section 220 includes a first HP section 240, a second HP section 242, and a third HP section 244. In another embodiment, the shaft HP section 220 may include one or more HP sections. The shaft HP section 220 is rotatably supported by a first bearing 236 (FIG. 1) and a second bearing 238 (FIG. 1). In an embodiment, for example, the first bearing 236 may be a journal bearing. In another embodiment, the second bearing 238 may be a thrust/journal bearing. In another embodiment, different support bearing configurations may be used. The first bearing 236 supports the first HP section 240, and the second bearing 238 supports the third HP section 244. In an embodiment where the HP section 242 extends to the bolted joint 230, the second bearing 238 supports the HP section 242. In another embodiment, different support bearing configurations may be used.

The first and third HP sections 240 and 244 are joined to the second HP section 242 by a first and a second weld 250 and 252, respectively. In this exemplary embodiment, the first weld 250 is located along the HP main steam flow path section 30 (FIG. 1) and the second weld 252 is located outside or not in contact with the HP main steam flow path section 30. In another embodiment, the first weld 250 may be located outside or not in contact with the HP main steam flow path section 30. In an alternate embodiment, the first weld 250 may be located at position "A" (FIG. 1) outside and not in contact with the HP main steam flow path section 30, but may be in contact with seal steam leakage.

High pressure steam is fed into the steam turbine 10 at the HP inflow region 28 and first contacts the shaft HP section 220 at the second HP section 242, or, in other words, high pressure steam is introduced adjacent to the second HP section 242. The HP section 242 at least partially defines the HP inflow region 28 and HP main steam flow path section 30

(FIG. 3). The first HP section 240 further at least partially defines the HP main steam flow path section 30. As discussed above, in another embodiment, the first weld 250 may be moved, for example, to position "A", so that the first HP section 242 does not at least partially define the HP main steam flow path section 30. The third HP section 244 does not at least partially define the main steam flow path 26, or, in other words, the third HP section 244 is outside of the HP main steam flow path section 30 and does not contact the main steam flow path 26.

In one embodiment, the first, second and third HP sections 240, 242 and 244 are formed of single, unitary sections or blocks of high temperature resistant material. The high temperature resistant material may be referred to as a high temperature material (HTM). In another embodiment, the HP sections may be formed of one or more HP sections or blocks of high temperature material that are joined together by a material joining technique, such as, but not limited to, welding and bolting. The first, second and third HP sections 240, 242 and 244 may be formed of the same HTM. In another embodiment, the first, second and third HP sections may be formed of different HTM.

The high temperature material may be a high-chromium alloy steel. In another embodiment, the high temperature material may be a steel including an amount of chromium (Cr), molybdenum (Mo), vanadium (V), manganese (Mn), and cobalt (Co). In an embodiment, the high temperature material may be a high-chromium alloy steel including 0.1-1.2 wt % of Mn, up to 1.5 wt % of Ni, 8.0-15.0 wt % of Cr, up to 4.0 wt % of Co, 0.5-3.0 wt % of Mo, 0.05-1.0 wt % of V, 0.02-0.5 wt % of Nb, 0.005-0.15 wt % of N, up to 0.04 wt % of B, up to 3.0 wt % of W, and balance Fe and incidental impurities.

In another embodiment the high temperature material may be a high-chromium alloy steel including 0.2-1.2 wt % of Mn, 9.0-13.0 wt % of Cr, 0.5-3.0 wt % of Mo, 0.05-1.0 wt % of V, 0.02-0.5 wt % of Nb, 0.02-0.15 wt % of N, and balance Fe and incidental impurities. In another embodiment, the high-chromium alloy includes 0.3-1.0 wt % of Mn, 10.0-11.5 wt % of Cr, 0.7-2.0 wt % of Mo, 0.05-0.5 wt % of V, 0.02-0.3 wt % of Nb, 0.02-0.10 wt % of N, and balance Fe and incidental impurities. In still another embodiment, the high-chromium alloy includes 0.4-0.9 wt % of Mn, 10.4-11.3 wt % of Cr, 0.8-1.2 wt % of Mo, 0.1-0.3 wt % of V, 0.04-0.15 wt % of Nb, 0.03-0.09 wt % of N, and balance Fe and incidental impurities.

In another embodiment the high temperature material may be a high-chromium alloy steel including 0.2-1.2 wt % of Mn, 0.2-1.5 wt % of Ni, 8.0-15.0 wt % of Cr, 0.5-3.0 wt % of Mo, 0.05-1.0 wt % of V, 0.02-0.5 wt % of Nb, 0.02-0.15 wt % of N, 0.2-3.0 wt % of W, and balance Fe and incidental impurities. In another embodiment, the high-chromium alloy includes 0.2-0.8 wt % of Mn, 0.4-1.0 wt % of Ni, 9.0-12.0 wt % of Cr, 0.7-1.5 wt % of Mo, 0.05-0.5 wt % of V, 0.02-0.3 wt % of Nb, 0.02-0.10 wt % of N, 0.5-2.0 wt % of W, and balance Fe and incidental impurities. In still another embodiment, the high-chromium alloy includes 0.3-0.7 wt % of Mn, 0.5-0.9 wt % of Ni, 9.9-10.7 wt % of Cr, 0.9-1.3 wt % of Mo, 0.1-0.3 wt % of V, 0.03-0.08 wt % of Nb, 0.03-0.09 wt % of N, 0.9-1.2 wt % of W, and balance Fe and incidental impurities.

In another embodiment the high temperature material may be a high-chromium alloy steel including 0.1-1.2 wt % of Mn, 0.05-1.00 wt % of Ni, 7.0-11.0 wt % of Cr, 0.5-4.0 wt % of Co, 0.5-3.0 wt % of Mo, 0.1-1.0 wt % of V, 0.02-0.5 wt % of Nb, 0.005-0.06 wt % of N, 0.002-0.04 wt % of B, and balance Fe and incidental impurities. In another embodiment, the high-chromium alloy includes 0.1-0.8 wt % of Mn, 0.08-0.4 wt % of Ni, 8.0-10.0 wt % of Cr, 0.8-2.0 wt % of Co, 1.0-2.0 wt % of Mo, 0.1-0.5 wt % of V, 0.02-0.3 wt % of Nb, 0.01-0.04 wt % of N, 0.005-0.02 wt % of B, and balance Fe and incidental impurities. In still another embodiment, the high-chromium alloy includes 0.2-0.5 wt % of Mn, 0.08-0.25 wt % of Ni, 8.9-937 wt % of Cr, 1.1-1.5 wt % of Co, 1.3-1.7 wt % of Mo, 0.15-0.3 wt % of V, 0.04-0.07 wt % of Nb, 0.014-0.032 wt % of N, 0.007-0.014 wt % of B, and balance Fe and incidental impurities.

In another embodiment, the one or both the first and third HP sections 240 and 244 may be formed of a less heat resistant material than the high temperature material forming the second HP section 242. The less heat resistant material may be referred to as a lower temperature material. The lower temperature material may be a low alloy steel. In an embodiment, the lower temperature material may be a low alloy steel including 0.05-1.5 wt % of Mn, 0.1-3.0 wt % of Ni, 0.05-5.0 wt % of Cr, 0.2-4.0 wt % of Mo, 0.05-1.0 wt % of V, up to 3.0 wt % of W and balance Fe and incidental impurities.

In another embodiment the lower temperature material may be a low alloy steel including 0.3-1.2 wt % of Mn, 0.1-1.5 wt % of Ni, 0.5-3.0 wt % of Cr, 0.4-3.0 wt % of Mo, 0.05-1.0 wt % of V, and balance Fe and incidental impurities. In another embodiment, the low alloy steel includes 0.5-1.0 wt % of Mn, 0.2-1.0 wt % of Ni, 0.6-1.8 wt % of Cr, 0.7-2.0 wt % of Mo, 0.1-0.5 wt % of V, and balance Fe and incidental impurities. In still another embodiment, the low alloy steel includes 0.6-0.9 wt % of Mn, 0.2-0.7 wt % of Ni, 0.8-1.4 wt % of Cr, 0.9-1.6 wt % of Mo, 0.15-0.35 wt % of V, and balance Fe and incidental impurities.

In another embodiment the lower temperature material may be a low alloy steel including 0.2-1.5 wt % of Mn, 0.2-1.6 wt % of Ni, 1.0-3.0 wt % of Cr, 0.2-2.0 wt % of Mo, 0.05-1.0 wt % of V, 0.2-3.0 wt % of W and balance Fe and incidental impurities. In another embodiment, the low alloy steel includes 0.4-1.0 wt % of Mn, 0.4-1.0 wt % of Ni, 1.5-2.7 wt % of Cr, 0.5-1.2 wt % of Mo, 0.1-0.5 wt % of V, 0.4-1.0 wt % of W and balance Fe and incidental impurities. In still another embodiment, the low alloy steel includes 0.5-0.9 wt % of Mn, 0.6-0.9 wt % of Ni, 1.8-2.4 wt % of Cr, 0.7-1.0 wt % of Mo, 0.2-0.4 wt % of V, 0.5-0.8 wt % of W and balance Fe and incidental impurities.

In another embodiment the lower temperature material may be a low alloy steel including 0.05-1.2 wt % of Mn, 0.5-3.0 wt % of Ni, 0.05-5.0 wt % of Cr, 0.5-4.0 wt % of Mo, 0.05-1.0 wt % of V, and balance Fe and incidental impurities. In another embodiment, the low alloy steel includes 0.05-0.7 wt % of Mn, 1.0-2.0 wt % of Ni, 1.5-2.5 wt % of Cr, 1.0-2.5 wt % of Mo, 0.1-0.5 wt % of V, and balance Fe and incidental impurities. In still another embodiment, the low alloy steel includes 0.1-0.3 wt % of Mn, 1.3-1.7 wt % of Ni, 1.8-2.2 wt % of Cr, 1.5-2.0 wt % of Mo, 0.15-0.35 wt % of V, and balance Fe and incidental impurities.

In an embodiment, the first and third HP sections 240 and 244 are formed of the same lower temperature material. In another embodiment, the first and second HP sections 240 and 244 are formed of different lower temperature materials.

The shaft IP section 222 is rotatably supported by an IP section bearing 264. In an embodiment, the bearing 264 may be a journal bearing. In another embodiment, the shaft IP section 222 may be rotatably supported by one or more bearings. The shaft IP section 222 receives steam at a pressure below about 70 bar. In another embodiment, the shaft IP section 222 may receive steam at a pressure of between about 20 bar to 70 bar. In yet another embodiment, the shaft IP section 222 may receive steam at a pressure of between about 20 bar to about 40 bar. Additionally, the shaft IP section 222 receives steam at a temperature of between about 565° C. and about 650° C. In another embodiment, the shaft IP section 222 may receive steam at a temperatures of between about 590° C. and about 625° C.

The shaft IP section 222 includes a first IP section 260 and a second IP section 262. The first and second IP sections 260 and 262 are joined by a third weld 266. The third weld 266 is located along the IP main steam flow path section 36. In another embodiment, the third weld 266 may be located outside or not in contact with the IP main steam flow path section 36. For example, the third weld 266 may be located at position "B" (FIG. 1) located outside and not in contact with the IP main steam flow path section 36. In another embodiment, the shaft IP section 222 may be formed of one or more IP sections. In another embodiment, the IP section 222 may be formed of a single, unitary block or section of high temperature material.

Referring again to FIG. 1, the first IP section 260 at least partially defines the IP main steam inflow region 34 and IP main steam flow path section 36. The second IP section 262 further, at least partially, defines the IP main steam flow path section 36. In another embodiment, the third weld 266 may be moved, for example, to position "B", so that the second IP section 262 does not, at least partially, define the IP main steam flow path section 36 or, in other words, the second IP section 262 is outside of the IP main steam flow path section 36 and does not contact the main flow path of steam.

In an embodiment, the first and second IP sections 260 and 262 are formed of a high temperature material. In an embodiment, one or both of the first and second IP sections 260 and 262 may be formed of a high temperature material. The high temperature material may be the high temperature material as discussed above in reference to the HP sections 240, 242 and 244.

The second IP section 262 may be formed of a less heat resistant material than the high temperature material, such as a lower temperature material. The lower temperature material may be the lower temperature material as discussed above in reference to the HP sections 240 and 244.

In one embodiment, the first and second IP sections 260 and 262 are each formed of a single, unitary high temperature material section or block. In another embodiment, the first and second IP sections 260 and 262 may each be formed of two or more IP sections welded together. The second IP section 262 may be formed of a less heat resistant material than the high temperature material utilized for the first IP section 260 and second HP section 242.

The shaft 24 may be produced by an embodiment of a method of manufacturing as described below. The shaft HP section 220 may be produced by welding blocks or sections of HTM to form the first, second and third HP sections 240, 242 and 244. In another embodiment, the shaft HP section 220 may be produced by providing one or more blocks or sections of a high temperature material that are joined together to form the shaft HP section 220.

The shaft IP section 222 may be produced by welding blocks or sections of HTM to form the first and second IP sections 260 and 262. In another embodiment, the shaft IP section 222 may be produced by providing one or more blocks or sections of a high temperature material that are joined together to form the shaft IP section 222.

The shaft 24 is produced by joining the shaft HP section 220 to the shaft IP section 222. The shaft HP section 220 is joined to the shaft IP section 222 by bolting the third HP section 244 of the first IP section 260. In another embodiment, the shaft HP section 220 may be joined to the shaft IP section 222 by bolting, welding or other metal joining technique.

While only certain features and embodiments of the invention have been shown and described, many modifications and changes may occur to those skilled in the art (for example, variations in sizes, dimensions, structures, shapes and proportions of the various elements, values of parameters (for example, temperatures, pressures, etc.), mounting arrangements, use of materials, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the invention. Furthermore, in an effort to provide a concise description of the exemplary embodiments, all features of an actual implementation may not have been described (i.e., those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A sectioned rotor, comprising:

a shaft high pressure section having a first end and a second end; and a shaft intermediate pressure section joined to the second end of the shaft high pressure section;

wherein the shaft high pressure section comprises:

a first high pressure section;

a second high pressure section, the second high pressure section joined to the first high pressure section at a first weld; and a third high pressure section, the third high pressure section joined to the second high pressure section at a second weld; and wherein the shaft intermediate pressure section comprises:

a first intermediate pressure section; and a second intermediate pressure section, the second intermediate pressure section joined to the first intermediate pressure section;

wherein at least a portion of the second high pressure section is formed of a high-chromium alloy steel comprising 0.1-1.2 wt % of Mn, up to 1.5 wt % of Ni, 8.0-15.0 wt % of Cr, up to 4.0 wt % of Co, 0.5-3.0 wt % of Mo, 0.05-1.0 wt % of V, 0.02-0.5 wt % of Nb, 0.005-0.15 wt % of N, up to 0.04 wt % of B, up to 3.0 wt % of W, and balance Fe and incidental impurities, and the first weld is along a main steam flow path and the shaft intermediate pressure section is joined to the third high pressure section of the shaft high pressure section by bolting, the third high pressure section being formed of a low-chromium alloy steel.

2. The rotor of claim 1, wherein the high-chromium alloy steel comprises 0.1-1.2 wt % of Mn, 0.05-1.00 wt % of Ni, 7.0-11.0 wt % of Cr, 0.5-4.0 wt % of Co, 0.5-3.0 wt % of Mo, 0.1-1.0 wt % of V, 0.02-0.5 wt % of Nb, 0.005-0.06 wt % of N, 0.002-0.04 wt % of B, and balance Fe and incidental impurities.

3. The rotor of claim 1, wherein the high-chromium alloy steel comprises 0.2-1.2 wt % of Mn, 0.2-1.5 wt % of Ni, 8.0-15.0 wt % of Cr, 0.5-3.0 wt % of Mo, 0.05-1.0 wt % of V, 0.02-0.5 wt % of Nb, 0.02-0.15 wt % of N, 0.2-3.0 wt % of W, and balance Fe and incidental impurities.

4. The rotor of claim 1, wherein the first and third high pressure sections are formed of a low alloy steel comprising 0.05-1.5 wt % of Mn, 0.1-3.0 wt % of Ni, 0.05-5.0 wt % of Cr, 0.2-4.0 wt % of Mo, 0.05-1.0 wt % of V, up to 3.0 wt % of W and balance Fe and incidental impurities.

5. The rotor of claim 1, wherein the first and third high pressure sections are formed of a low alloy steel comprising 0.3-1.2 wt % of Mn, 0.1-1.5 wt % of Ni, 0.5-3.0 wt % of Cr, 0.4-3.0 wt % of Mo, 0.05-1.0 wt % of V, and balance Fe and incidental impurities.

6. The rotor of claim 1, wherein the first and third high pressure sections are formed of a low alloy steel comprising 0.2-1.5 wt % of Mn, 0.2-1.6 wt % of Ni, 1.0-3.0 wt % of Cr, 0.2-2.0 wt % of Mo, 0.05-1.0 wt % of V, 0.2-3.0 wt % of W and balance Fe and incidental impurities.

7. The rotor of claim 1, wherein the first intermediate pressure section is formed of a high-chromium alloy steel comprising 0.1-1.2 wt % of Mn, up to 1.5 wt % of Ni, 8.0-15.0 wt % of Cr, up to 4.0 wt % of Co, 0.5-3.0 wt % of Mo, 0.05-1.0 wt % of V, 0.02-0.5 wt % of Nb, 0.005-0.15 wt % of N, up to 0.04 wt % of B, up to 3.0 wt % of W, and balance Fe and incidental impurities.

8. A steam turbine, comprising:

a rotor, comprising:

a shaft high pressure section having a first end and a second end; and a shaft intermediate pressure section joined to the second end of the shaft high pressure section;

wherein the shaft high pressure section comprises:

a first high pressure section;

a second high pressure section, the second high pressure section joined to the first high pressure section at a first weld; and a third high pressure section, the third high pressure section joined to the second high pressure section at a second weld; and wherein the shaft intermediate pressure section comprises:

a first intermediate pressure section; and a second intermediate pressure section, the second intermediate pressure section joined to the first intermediate pressure section; and wherein at least a portion of the second high pressure section is formed of a high-chromium alloy steel comprising 0.1-1.2 wt % of Mn, up to 1.5 wt % of Ni, 8.0-15.0 wt % of Cr, up to 4.0 wt % of Co, 0.5-3.0 wt % of Mo, 0.05-1.0 wt % of V, 0.02- 0.5 wt % of Nb, 0.005-0.15 wt % of N, up to 0.04 wt % of B, up to 3.0 wt % of W, and balance Fe and incidental impurities, and the first weld is along a main steam flow path and the shaft intermediate pressure section is joined to the third high pressure section of the shaft high pressure section by bolting, the third high pressure section being formed of a low-chromium alloy steel.

9. The steam turbine of claim 8, wherein the high-chromium alloy steel comprises 0.1-1.2 wt % of Mn, 0.05-1.00 wt % of Ni, 7.0-11.0 wt % of Cr, 0.5-4.0 wt % of Co, 0.5-3.0 wt % of Mo, 0.1-1.0 wt % of V, 0.02-0.5 wt % of Nb, 0.005-0.06 wt % of N, 0.002-0.04 wt % of B, and balance Fe and incidental impurities.

10. The steam turbine of claim 8, wherein the high-chromium alloy steel comprises 0.2-1.2 wt % of Mn, 0.2-1.5 wt % of Ni, 8.0-15.0 wt % of Cr, 0.5-3.0 wt % of Mo, 0.05-1.0 wt % of V, 0.02-0.5 wt % of Nb, 0.02-0.15 wt % of N, 0.2-3.0 wt % of W, and balance Fe and incidental impurities.

11. The steam turbine of claim 8, wherein the first and third high pressure section are formed of a low alloy steel comprising 0.05-1.5 wt % of Mn, 0.1-3.0 wt % of Ni, 0.05-5.0 wt % of Cr, 0.2-4.0 wt % of Mo, 0.05-1.0 wt % of V, up to 3.0 wt % of W and balance Fe and incidental impurities.

12. The steam turbine of claim 8, wherein the first and third high pressure section are formed of a low alloy steel comprising 0.3-1.2 wt % of Mn, 0.1-1.5 wt % of Ni, 0.5-3.0 wt % of Cr, 0.4-3.0 wt % of Mo, 0.05-1.0 wt % of V, and balance Fe and incidental impurities.

13. The steam turbine of claim 8, wherein the first and third high pressure section are formed of a low alloy steel comprising 0.2-1.5 wt % of Mn, 0.2-1.6 wt % of Ni, 1.0-3.0 wt % of Cr, 0.2-2.0 wt % of Mo, 0.05-1.0 wt % of V, 0.2-3.0 wt % of W and balance Fe and incidental impurities.

14. The steam turbine of claim 8, wherein the first intermediate pressure section is formed of a high-chromium alloy steel comprising 0.1-1.2 wt % of Mn, up to 1.5 wt % of Ni, 8.0-15.0 wt % of Cr, up to 4.0 wt % of Co, 0.5-3.0 wt % of Mo, 0.05-1.0 wt % of V, 0.02-0.5 wt % of Nb, 0.005-0.15 wt % of N, up to 0.04 wt % of B, up to 3.0 wt % of W, and balance Fe and incidental impurities.

15. The steam turbine of claim 8, further comprising:

a high pressure casing surrounding the rotor high pressure section and an intermediate pressure casing surrounding the rotor intermediate pressure section, wherein the high pressure casing and the intermediate pressure casing are not integral.

16. The steam turbine of claim 8, wherein the intermediate pressure section includes a double wall casing.

17. The steam turbine of claim 8, wherein the intermediate pressure section includes a single wall casing.

18. A method of manufacturing a rotor, comprising:

providing a first, second and third high pressure sections; and joining the first, second and third high pressure sections to form a shaft high pressure section, wherein the second high pressure section is joined to the first high pressure section at a first weld and the third high pressure section is joined to the second pressure section at a second weld;

providing a first and second intermediate pressure sections;

joining the first and second intermediate pressure sections to form a shaft intermediate pressure section; and joining the shaft high pressure rotor section and the shaft intermediate pressure sections to form a rotor;

wherein at least a portion of the second high pressure section is formed of a high-chromium alloy steel comprising 0.1-1.2 wt % of Mn, up to 1.5 wt % of Ni, 8.0-15.0 wt % of Cr, up to 4.0 wt % of Co, 0.5-3.0 wt % of Mo, 0.05-1.0 wt % of V, 0.02-0.5 wt % of Nb, 0.005-0.15 wt % of N, up to 0.04 wt % of B, up to 3.0 wt % of W, and balance Fe and incidental impurities, and the first weld is along a main steam flow path and the shaft intermediate pressure section is joined to the third high pressure section of the shaft high pressure section by bolting, the third high pressure section being formed of a low-chromium alloy steel.

* * * * *